US011698086B2

(12) United States Patent
Froemming et al.

(10) Patent No.: US 11,698,086 B2
(45) Date of Patent: Jul. 11, 2023

(54) SYSTEMS AND METHODS TO CONTROL MOVEMENT OF A WORK VEHICLE ATTACHMENT

(71) Applicant: CNH Industrial America LLC, New Holland, PA (US)

(72) Inventors: Dana Lee Froemming, Fargo, ND (US); Jonathan Richard Nistler, Moorhead, MN (US); Michael Sylvester Bares, Fargo, ND (US)

(73) Assignee: CNH INDUSTRIAL AMERICA LLC, New Holland, PA (US)

( * ) Notice: Subject to any disclaimer, the term of this patent is extended or adjusted under 35 U.S.C. 154(b) by 90 days.

(21) Appl. No.: 17/126,770

(22) Filed: Dec. 18, 2020

(65) Prior Publication Data

US 2022/0196042 A1 Jun. 23, 2022

(51) Int. Cl.

| | |
|---|---|
| ***F15B 15/20*** | (2006.01) |
| ***E02F 9/22*** | (2006.01) |
| *E02F 3/43* | (2006.01) |

(52) U.S. Cl.

CPC ..... *F15B 15/20* (2013.01); *E02F 9/2228* (2013.01); *E02F 3/431* (2013.01); *E02F 9/2235* (2013.01); *E02F 9/2271* (2013.01)

(58) Field of Classification Search

CPC ..... E02F 9/2228; E02F 3/96

See application file for complete search history.

(56) References Cited

U.S. PATENT DOCUMENTS

| | | | | |
|---|---|---|---|---|
| 6,437,701 | B1 * | 8/2002 | Muller | E02F 9/26 340/684 |
| 7,630,793 | B2 | 12/2009 | Thomas et al. | |
| 9,080,319 | B2 | 7/2015 | Oates, Jr. et al. | |
| 10,289,097 | B2 | 5/2019 | Butler | |
| 10,400,426 | B2 | 9/2019 | Yamashita et al. | |
| 2003/0051470 | A1 | 3/2003 | Maddock | |
| 2010/0185335 | A1 | 7/2010 | Sawada | |
| 2013/0078069 | A1 * | 3/2013 | May | E02F 9/006 29/401.1 |
| 2014/0173946 | A1 * | 6/2014 | Gerrits | E02F 9/2004 56/14.7 |
| 2014/0320293 | A1 * | 10/2014 | Hunter, Jr. | E02F 3/96 340/626 |
| 2019/0234047 | A1 * | 8/2019 | Nygren | E02F 9/2004 |
| 2019/0264420 | A1 * | 8/2019 | Henn | E02F 9/2214 |
| 2019/0264423 | A1 | 8/2019 | Kenkel et al. | |

* cited by examiner

*Primary Examiner* — Thomas E Lazo

(74) *Attorney, Agent, or Firm* — Rickard Demille; Rebecca Henkel

(57) ABSTRACT

A system has a hydraulic circuit configured to control a position of an attachment of the system and a control system configured to perform operations that include receiving an input indicative of a center of gravity of the attachment and controlling a flow rate of fluid directed through the hydraulic circuit based on the center of gravity.

15 Claims, 5 Drawing Sheets

SYSTEMS AND METHODS TO CONTROL MOVEMENT OF A WORK VEHICLE ATTACHMENT

BACKGROUND

The disclosure relates generally to control of a work vehicle attachment. Specifically, this disclosure relates to controlling movement of an attachment of a work vehicle based on information associated with the attachment.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of any kind.

A work vehicle, such as a tractor or a skid steer, may couple to different types of attachments (e.g., a loader assembly, a dozer assembly) to perform various functions. For example, the work vehicle may use or switch between different loader assemblies to perform a wide variety of tasks, including construction, transportation of materials, excavation, landscaping, among others. Certain attachments may be powered by an engine of the work vehicle, which operates a hydraulic pump configured to circulate a flow of fluid (e.g., hydraulic oil) through respective hydraulic circuit(s) of the attachment (e.g., a loader assembly). The flow of fluid may cause movement of the attachment (e.g., relative to the work vehicle). It is presently desirable to control the movement of the attachment based on various properties associated with the attachment, such as to limit a stress or a force imparted onto the attachment and/or onto the work vehicle.

BRIEF DESCRIPTION

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In certain embodiments, a system has a hydraulic circuit configured to control a position of an attachment of the system and a control system configured to perform operations that include receiving an input indicative of a center of gravity of the attachment and controlling a flow rate of fluid directed through the hydraulic circuit based on the center of gravity.

DRAWINGS

These and other features, aspects, and advantages of the present disclosure will become better understood when the following detailed description is read with reference to the accompanying drawings in which like characters represent like parts throughout the drawings, wherein.

Figure 2:
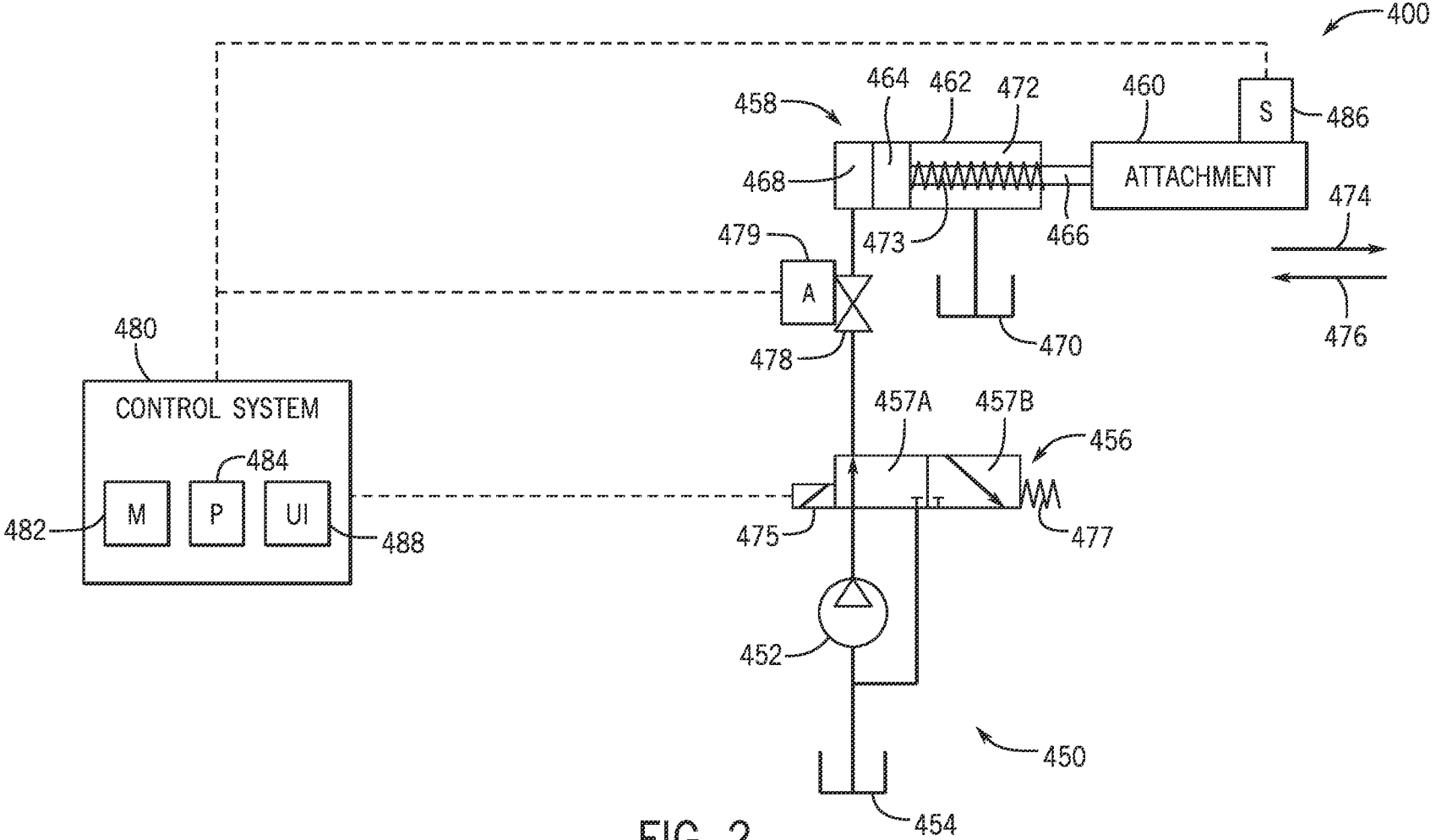
FIG. 2 is a schematic diagram of an embodiment of a hydraulic control system that may be used to control movement of an attachment coupled to the work vehicle of FIG. 1, in accordance with an embodiment of the present disclosure.
Figure 5:
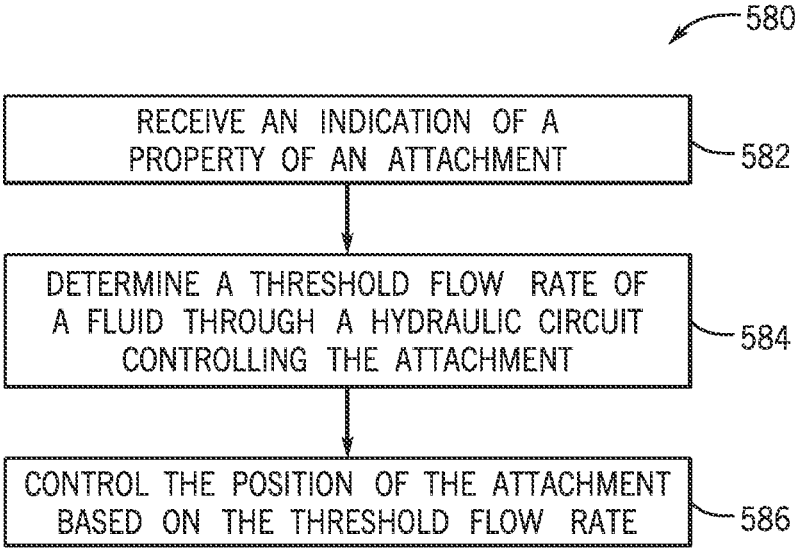
Figure 6:
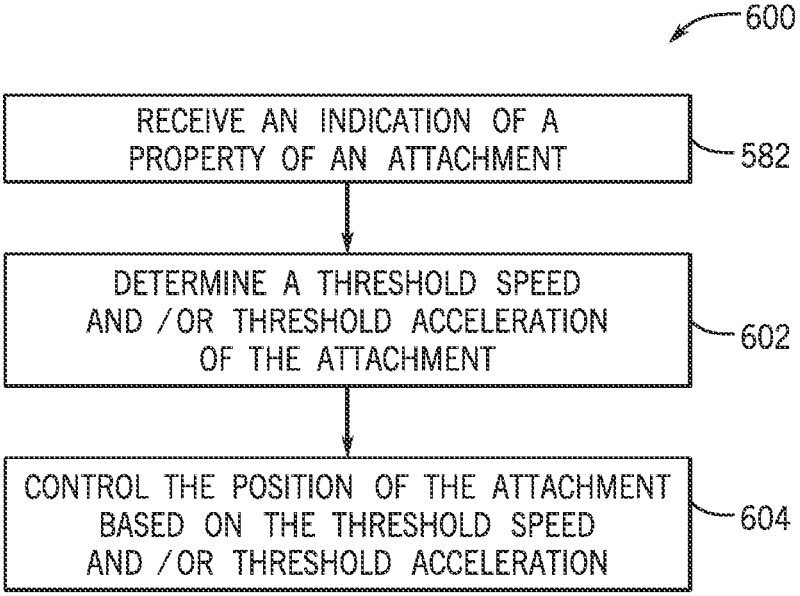

FIG. 5 is a flowchart of an embodiment of a method for controlling a position of the attachment of FIG. 2 based on a property of the attachment, in accordance with an embodiment of the present disclosure; and FIG. 6 is a flowchart of an embodiment of a method for controlling a position of the attachment of FIG. 2 based on a property of the attachment, in accordance with an embodiment of the present disclosure.

DETAILED DESCRIPTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments.

A system (e.g., an agricultural system, an earth-moving system, a construction system, etc.) may be configured to perform various operations. For example, the system may include a work vehicle configured to couple to various attachments, and a particular attachment may be selected and used based on a specific operation of the system. During certain operations, the system may move the attachment. In some embodiments, the system may include a hydraulic circuit through which a fluid flows to cause the movement of the attachment. The hydraulic circuit may be controlled to direct the fluid flow, thereby controlling the position and/or orientation of the attachment, as well as a speed and/or acceleration at which the attachment is moved. As used herein, moving the attachment includes moving at least a portion of the attachment relative to the work vehicle and/or moving portions of the attachment relative to one another.

In certain existing systems, the operation of the hydraulic circuit may not be based on the attachment that is currently employed. For example, the flow rate of the fluid through the hydraulic circuit may be the same regardless of the attachment coupled to the work vehicle. Thus, each of the attachments may move at the same speed and/or acceleration. However, for certain attachments, such operation of the hydraulic circuit may impart an undesirable amount of stress onto the system. For example, moving a larger attachment at a particular speed may impart a different amount of stress onto the system than that caused by moving a smaller attachment at the same speed.

Accordingly, it is desirable to adjust the manner in which an attachment may be moved based on various aspects associated with the attachment. In some embodiments, a property associated with the attachment may be determined, and the hydraulic circuit may be controlled based on the determined property. By way of example, a flow rate of fluid within the hydraulic circuit may be based on a mass, a center of gravity, a current position, a current orientation, and so forth, of the attachment. For example, a threshold flow rate of fluid may be determined based on the property, and the hydraulic circuit may be controlled to direct fluid through the hydraulic circuit at a flow rate that is below the threshold flow rate. In this way, the hydraulic system may be controlled to limit a stress imparted onto the system caused by positioning of the attachment, thereby improving operation of the system.

Figure 1:
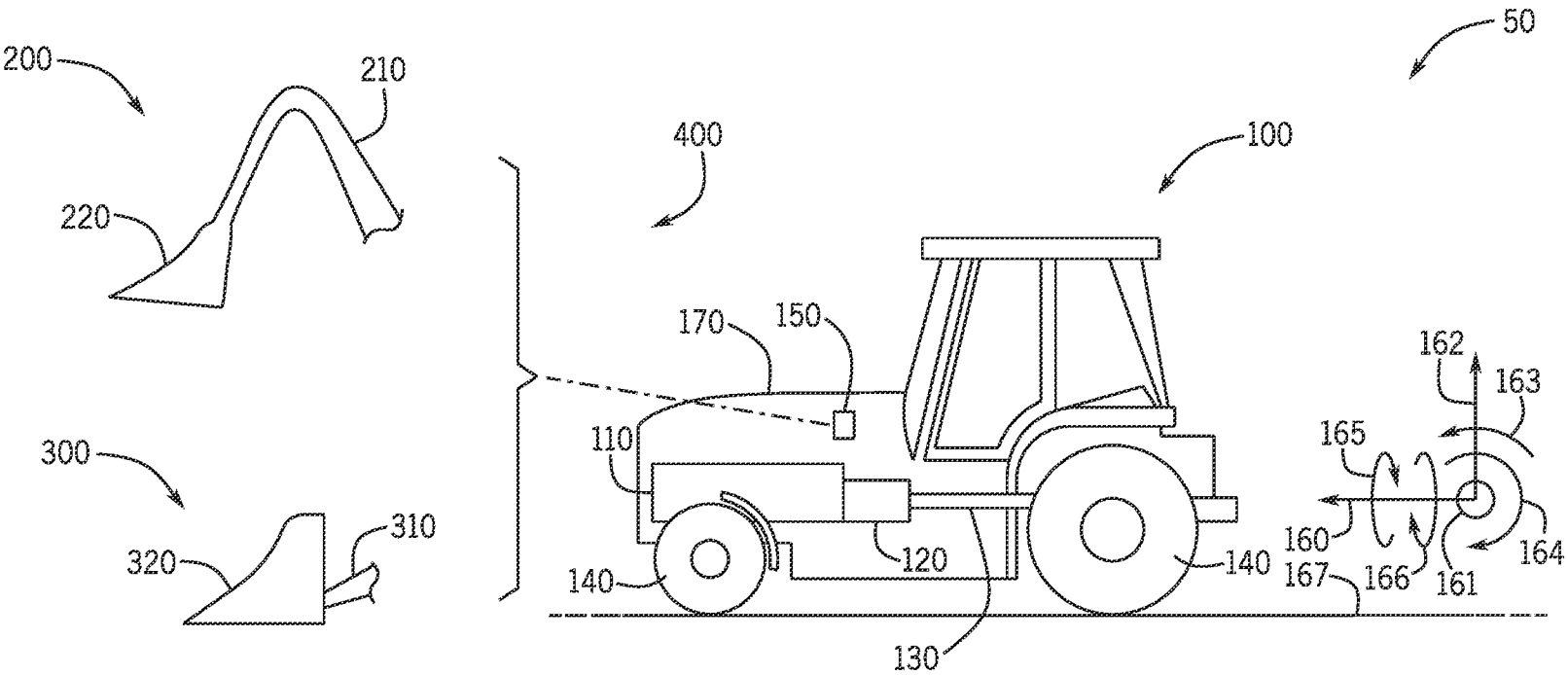
FIG. 1 is a side view of a system that includes a work vehicle configured to couple to different attachments, in accordance with an embodiment of the present disclosure.

With the preceding in mind, FIG. 1 is a side view of a system 50 that includes a work vehicle 100 (e.g., a tractor) configured to couple to different types of attachments of the system 50. The work vehicle 100 may include a cab that may at least partially surround an operator controlling operation of the work vehicle 100. The work vehicle 100 includes an engine 110, a transmission assembly 120, a drive shaft 130, and wheels 140. The transmission assembly 120 is coupled to the engine 110 to transfer power from the engine 110 to the drive shaft 130, which powers the wheels 140 of the work vehicle 100. In additional or alternative embodiments, the work vehicle may be a different type of work vehicle, such as an electrically powered work vehicle, having other components and features to enable operation of the work vehicle. In some embodiments, the work vehicle 100 may include one or more sensors 150 (e.g., inductive proximity sensor(s), capacitive proximity sensor(s), strain gauge(s), load cell(s), speed sensor(s), accelerometer(s), vibration sensor(s), force or resistance sensor(s), load level sensor(s), angle sensor(s), load weight sensor(s), location stability sensor(s)) that may be used to facilitate control of the system 50. For example, feedback from the sensor(s) may be used for controlling the attachment coupled to the work vehicle 100. As shown, the system 50 may be described with reference to a longitudinal axis 160, a lateral axis 161, a vertical axis 162, a first rotational direction 163 and a second rotational direction 164 (e.g., pitch directions) about the lateral axis 161, and a third rotational direction 165 and a fourth rotational direction 166 (e.g., roll directions) about the longitudinal axis 160. Further, the position of the system 50 may be described relative to a ground 167.

The work vehicle 100 may include a frame 170, which may be configured to couple to one of multiple different types of attachments, such as a first attachment 200 and/or a second attachment 300. In the illustrated embodiment, each of the first attachment 200 and the second attachment 300 are loader assemblies. However, the work vehicle 100 may be coupled to any suitable type of attachment at the frame 170, such as an asphalt miller, a bale spear, a barrier lift, a bucket, a backhoe, a cold planer, a concrete claw, demolition equipment, a dozer blade, a grapple bucket, a harley rake, a hydraulic brush cutter, a forestry mulcher, a pallet fork, a post driver, a rock saw, a root grapple, a rotary broom, a stump grinder, a tiller, a tree shear, a trench digger, or a vibratory roller, among others. The first attachment 200 and/or the second attachment 300 may be operable through a hydraulic control system 400, among other control systems (e.g., hydraulic and/or electrical control systems), of the work vehicle 100. As discussed in detail below, the engine 110 and/or the transmission assembly 120 may be coupled to one or more pumps (e.g., hydraulic pumps) of the hydraulic control system 400, which are configured to circulate hydraulic fluid (e.g., oil) through the hydraulic control system 400 to control operation of the first attachment 200 and/or of the second attachment 300. In some embodiments, the sensors 150 are communicatively coupled to the hydraulic control system 400 and are configured to detect a position and/or an orientation of the first attachment 200 and/or of the second attachment 300. The data from the sensors 150 may be used to control movement of the first attachment 200 and/or of the second attachment 300.

In the illustrated embodiment, the first attachment 200 includes one or more arms 210 that pivotably couple to the frame 170 of the work vehicle 100 and are rotatable with respect thereto by one or more hydraulic cylinders. For example, the one or more arms 210 may include structural member(s) and/or actuator(s), and the arms 210 may be raised and lowered with respect to the ground 167 (e.g., by extending or contracting the actuator(s)). The first attachment 200 also includes, among other things, a material handling element, such as a first bucket 220, which is pivotably coupled to the one or more arms 210 and is rotatable with respect thereto by one or more hydraulic cylinders (e.g., additional hydraulic cylinders) of the hydraulic control system 400. For example, the one or more hydraulic cylinders may drive the one or more arms 210 to move relative to the work vehicle 100 and/or to drive the first bucket 220 to tilt or rotate in the first rotational direction 163 and in the second rotational direction 164.

In the illustrated embodiment, the second attachment 300 also includes one or more arms 310 that pivotably couple to the frame 170 of the work vehicle 100 and are rotatable with respect thereto by one or more hydraulic cylinders. For example, the one or more arms 310 may include structural member(s) and/or actuator(s), and the arms 310 may be raised and lowered with respect to the ground 167 (e.g., by extending or contracting the actuator(s)). The second attachment 300 also includes, among other things, a material handling element, such as a second bucket 320, which is pivotably coupled to the one or more arms 310 and is rotatable with respect thereto by one or more hydraulic cylinders (e.g., additional hydraulic cylinders) of the hydraulic control system 400. For example, the one or more hydraulic cylinders may drive the one or more arms 310 to move relative to the work vehicle 100 and/or to drive the second bucket 320 to tilt or rotate in the first rotational direction 163 and in the second rotational direction 164.

The illustrated arms 310 of the second attachment 300 have a different length (e.g., are shorter) than the arms 210 of the first attachment 200. For this reason, when the first attachment 200 is coupled to the work vehicle 100, the first bucket 220 may be at a different position relative to the work vehicle 100 than that of the second bucket 320 when the second attachment 300 is coupled to the work vehicle. Accordingly, the first bucket 220 may impart a different amount of stress, such as tension, bending, shear, torsion, or a combination thereof, onto the system 50 (e.g., onto the arms 210, onto a part of the work vehicle 100) than that imparted by the second bucket 320. Additionally or alternatively, the first attachment (e.g., the first bucket of the first attachment) and the second attachment (e.g., the second bucket of the second attachment) may have different weights than one another, which causes different amounts of stress to be imparted onto the system. In any case, different attachments may cause different magnitudes of force(s) and/or torque(s) to be imparted onto the system 50 when installed.

In some embodiments, each of the first attachment 200 and the second attachment 300 is removably coupled to the work vehicle 100. For example, the one more arms 210 of the first attachment 200 may be removably coupled to the frame 170, and the one or more arms 310 of the second attachment 300 may be removably coupled to the frame 170. In additional or alternative embodiments, the arm(s) may be a part of the work vehicle, and the material handling element may be removably coupled to the arm(s). In any case, the first attachment 200 or the second attachment 300 may be coupled to the work vehicle 100 based on a particular operation of the system 50, such as a type of material on which the system 50 is to operate, a manner in which material is to be moved, a duration of operation of the system 50, and the like.

In certain embodiments, the hydraulic control system 400 may be a part of the work vehicle 100. That is, the same hydraulic control system 400 may be used to operate different attachments, such as to actuate the actuator(s) of the arms of the attachments to move the attachments. In such embodiments, the flow rate of fluid directed through the hydraulic control system 400 may primarily be adjusted on properties of the attachment coupled to the work vehicle 100. In additional or alternative embodiments, the hydraulic circuit may be a part of the different attachments and may therefore be changed with the attachments. In such embodiments, the flow rate of fluid directed through the hydraulic circuit may also be adjusted based on properties of the hydraulic circuit (e.g., a size of a hydraulic cylinders, a configuration of a valve) in addition to the properties of the attachment.

FIG. 2 is a schematic diagram of an embodiment of the hydraulic control system 400 that may be used to control movement of an attachment coupled to the work vehicle 100 of FIG. 1. The hydraulic control system 400 includes a hydraulic circuit 450 having a pump 452 and various conduits (e.g., tubing, piping, and so forth) through which a fluid (e.g., hydraulic fluid, hydraulic oil, etc.) may flow. The pump 452 is configured to direct the fluid from a first reservoir 454 (e.g., a first fluid source) to a first valve 456. The first valve 456 is configured to transition between a first position 457A and a second position 457B. While the first valve 456 is in the illustrated first position 457A, the first valve 456 enables the pump 452 to direct the fluid from the first reservoir 454 toward a hydraulic cylinder 458 that is coupled to a portion of an attachment 460 (e.g., the first attachment or the second attachment of FIG. 1). The flow of fluid into the hydraulic cylinder 458 may cause movement of the attachment 460, such as by extending, retracting, tilting, pitching, pivoting, and so forth, the portion of the attachment 460. Therefore, the fluid directed by the pump 452 into the hydraulic cylinder 458 may cause movement of the portion of the attachment 460. For example, the movement of fluid through the hydraulic cylinder 458 may cause movement of the attachment relative to the work vehicle, movement of the material handling element relative to the arm(s), and the like. The hydraulic cylinder 458 includes a body 462 and a piston 464 disposed within the body 462. The piston 464 includes a rod 466 that extends through the body 462 and couples to the attachment 460. The pump 452 is fluidly coupled to a cap end 468 of the body 462, and a second reservoir 470 is fluidly coupled to a rod end 472 of the body 462. Accordingly, the pump 452 may direct fluid from the first reservoir 454 into the cap end 468 to drive the piston 464 to move in a first direction 474 (e.g., to extend the rod 466 further out of the body 462), and movement of the piston 464 in the first direction 474 may cause fluid in the rod end 472 of the body 462 to flow into the second reservoir 470.

Furthermore, the first valve 456 is configured to transition to a second position 457B that enables fluid to flow out of the cap end 468 of the body 462 and toward the first reservoir 454. For example, the hydraulic cylinder 458 may include a spring 473 (e.g., a spring 473 coiled about the rod 466) that exerts a force to drive the piston 464 in a second direction 476 opposite the first direction 474 (e.g., to retract the rod 466). Thus, while the first valve 456 is in the second position 457B, hydraulic pressure exerted onto the piston 464 at the cap end 468 is reduced, and the spring 473 may cause the piston 464 to transition to the first position 457A. Fluid from the cap end 468 is then directed to the first reservoir 454 (e.g., by bypassing the pump 452). Thus, the first valve 456 may transition between the first position 457A and the second position 457B to control movement of the piston 464 and therefore of the attachment 460. In additional or alternative embodiments, fluid flow into and/or out of the rod end may be controlled to move the piston. For instance, the hydraulic circuit may be controlled to direct fluid flow into the rod end (e.g., from the first reservoir via the pump) to exert a hydraulic pressure onto the piston at the rod end.

In the illustrated embodiment, the first valve 456 is a single-acting solenoid valve. That is, the first valve 456 includes a solenoid 475 that is communicatively coupled to the electrical control system 480 as well as a spring 477. The spring 477 may exert a force onto the first valve 456 to drive the first valve 456 toward the second position 457B. The solenoid 475 may be configured to receive a signal that causes the solenoid 475 to actuate and force the first valve 456 to move against the force exerted by the spring 477 in order to drive the first valve 456 to the first position 457A. Thus, the illustrated first valve 456 may be in the first position 457A when the solenoid receives the signal, and the first valve 456 may be in the second position 457B when the solenoid 475 does not receive the signal. In additional or alternative embodiments, the first valve may be a double-acting solenoid that may include a first solenoid and a second solenoid. The first solenoid may receive a first signal that causes the first valve to transition to the first position, and the second solenoid may receive a second signal that causes the first valve to transition to the second position. In this manner, different signals may be output to transition the first valve between the first and second position.

The illustrated hydraulic circuit 450 also includes a second valve 478 positioned between the first valve 456 and the hydraulic cylinder 458 relative to a flow of the fluid between the first valve 456 and the hydraulic cylinder 458. The second valve 478 may be operated to control a flow rate of fluid between the first valve 456 and the hydraulic cylinder 458. For example, the second valve 478 may include an actuator 479 that is controllable to adjust an opening of the second valve 478 in order to control the flow rate of fluid into the cap end 468 of the body 462 while the first valve 456 is in the first portion, thereby adjusting a movement speed or acceleration of the piston 464 and, therefore, of the attachment 460 or a portion of the attachment 460 in the first direction 474. The opening of the second valve 478 may also be adjusted to control a flow rate of the fluid out of the cap end 468 of the body 462 while the first valve 456 is in the second position 457B, thereby adjusting a movement speed or acceleration of the piston 464 and, therefore, of the attachment 460 in the second direction 476. In this way, the first valve 456 may be controlled to control a direction in which the attachment 460 may move, and the second valve 478 may be controlled to control a speed or an acceleration of the movement of the attachment 460. In additional or alternative embodiments, a single valve (e.g., the first valve 456) may be used to control both the direction of flow into or out of the hydraulic cylinder as well as the flow rate of fluid directed into or out of the hydraulic cylinder. Indeed, a single proportional control valve may be used to control the manner in which fluid flows into or out of the hydraulic cylinder.

The hydraulic control system 400 includes an electrical control system 480 (e.g., an electronic controller) configured to operate the hydraulic circuit 450 to control movement of the attachment 460. The electrical control system 480 includes a memory 482 and processing circuitry 484. The memory 482 may include volatile memory, such as random-access memory (RAM), and/or non-volatile memory, such as read-only memory (ROM), optical drive(s), hard disc drive(s), solid-state drive(s), or any other non-transitory computer readable medium that includes instructions executable by the processing circuitry 484. The processing circuitry 484 may include one or more application specific integrated circuits (ASICs), one or more field programmable gate arrays (FPGAs), one or more general purpose processors, or any combination thereof, configured to execute the instructions stored in the memory 482 to operate the hydraulic circuit 450. For example, the instructions stored in the memory 482 cause the processing circuitry 484 to output a control signal to components of the hydraulic circuit 450 to direct fluid and move the piston 464.

By way of example, the electrical control system 480 is communicatively coupled to the first valve 456. In the illustrated embodiment, the electrical control system 480 may output a signal to the solenoid 475 to instruct the first valve 456 to transition between the first position 457A and the second position 457B, thereby controlling the direction in which fluid may flow between the first valve 456 and the hydraulic cylinder 458 to control the direction of movement of the attachment 460. In certain embodiments, the electrical control system 480 may also output a signal to the first valve 456 (e.g., the solenoid of the first valve 456) to control a particular flow rate of fluid flow between the pump 452 and the hydraulic cylinder 458. For instance, the first valve 456 may be a proportional control valve, and the electrical control system 480 may be configured to control the first valve 456 (e.g., an opening of the first valve 456) to control the flow rate of fluid through the first valve 456 in addition to the direction of flow through the fluid. Further still, the electrical control system 480 may be communicatively coupled to the second valve 478 to control the flow rate of fluid between the first valve 456 and the hydraulic cylinder 458. For example, the electrical control system 480 may output a signal to instruct valve 478 to adjust the size of the opening, thereby adjusting the rate of fluid flowing into or out of the cap end 468 of the body 462, thereby adjusting a speed and/or an acceleration of the movement of the attachment 460.

In some embodiments, the pump 452 (e.g., a constant speed, variable displacement) may be controlled via hydraulic feedback, such as based on a hydraulic pressure in the hydraulic cylinder 458 (e.g., in the rod end 472). That is, the hydraulic pressure in the hydraulic cylinder 458 may mechanically adjust a configuration of the pump 452 and cause the pump 452 to adjust an amount of fluid delivered to the hydraulic cylinder 458. For example, such operation may enable the pump 452 to direct fluid from the first reservoir 454 toward the hydraulic cylinder 458 (e.g., when the first valve 456 is in the first position 457A) or to suspend operation of the pump 452 (e.g., when the first valve 456 is in the second position 457B). Indeed, the pump 452 may adjust a flow volume or rate of fluid directed from the first reservoir to the first valve 456 and to the hydraulic cylinder 458. In additional or alternatively embodiments, the electrical control system is communicatively coupled to the pump and may output a signal to control operation of the pump. In further embodiments, the pump may not be controllable and may always be in operation to direct fluid out of the first reservoir 454 and toward the hydraulic cylinder 458.

Although the illustrated hydraulic circuit 450 fluidly couples the first reservoir 454 to the cap end 468 of the body 462, thereby enabling the pump 452 to direct fluid into the cap end 468, additional or alternative hydraulic circuits may fluidly couple the first reservoir to the rod end of the body. For example, the pump may additionally or alternatively direct fluid into the rod end of the body to control movement of the piston in the first direction and in the second direction. Further, additional or alternative hydraulic control systems may include any other suitable components (e.g., valves, conduits) that may control fluid flow into and/or out of the hydraulic cylinder to control movement of the attachment.

The electrical control system 480 may be configured to control the flow rate of fluid into and/or out of the hydraulic cylinder 458 based on various parameters. For instance, the electrical control system 480 may limit a flow rate of fluid into and/or out of the hydraulic cylinder 458, thereby limiting a speed and/or acceleration of the movement of the attachment 460 to reduce stress imparted onto the system. By way of example, the electrical control system 480 may be communicatively coupled to a sensor 486 configured to detect a parameter. The sensor 486 may output sensor data to the electrical control system 480 indicative of the parameter, and the electrical control system 480 may adjust an operation of the hydraulic circuit 450 based on the received sensor data. As an example, the sensor 486 may be configured to determine a property of the attachment 460, such as a weight, a center of gravity, a current position, a strain on a portion of the attachment 460 (e.g., of an arm), a visualization (e.g., a geometry) or a type of the attachment 460, another suitable property, or any combination thereof, of the attachment 460. The electrical control system 480 may receive sensor data indicative of the property of the attachment, determine a suitable manner (e.g., a manner that limits stress to a target value) in which the attachment 460 may be moved based on the sensor data, and control the hydraulic circuit 450 (e.g., a position of the first valve 456, a flow rate through the second valve 478) accordingly. As another example, the sensor 486 may output a signal indicative of a current movement speed and/or a current movement acceleration (e.g., of linear movement and/or of rotational movement) of the attachment 460. The electrical control system 480 may receive sensor data indicative of the current movement speed and/or the current movement acceleration of the attachment 460, and the electrical control system 480 may determine whether such movement speed and/or movement acceleration is desirable. That is, for instance, the electrical control system 480 may determine a threshold speed and/or a threshold acceleration of the attachment 460 (e.g., based on a detected property of the attachment 460), determine whether the current speed and/or the current acceleration of the attachment 460 matches with or is below the threshold speed and/or the threshold acceleration of the attachment 460, and output a signal to adjust operation of the hydraulic circuit 450 accordingly.

The electrical control system 480 may also include a user interface 488 that may be used to control operation of the hydraulic control system 400, such as in addition to or as an alternative to the sensor data received from the sensor 486. By way of example, the electrical control system 480 may store a list of attachments and information (e.g., a property) associated with each of the attachments, such as within the memory 482. The user interface 488 may include any suitable feature(s), such as touchscreen(s), button(s), lever(s), dial(s), switch(es), trackpad(s), camera(s), voice-recognition software, and so forth, with which a user may interact. The user may utilize the user interface 488 to indicate that one of the attachments from the list of attachments is currently being used in the system, and the electrical control system 480 may control the hydraulic circuit 450 based on the information (e.g., a property) associated with the indicated attachment. In another example, the user may utilize the user interface 488 to directly input the property of the attachment 460, such as with user input entries (e.g., text input, voice input), and the electrical control system 480 may control the hydraulic circuit 450 based on the user input property. The user may also utilize the user interface 488 to cause movement of the attachment 460. By way of example, the user may indicate a threshold position/orientation of the attachment 460, and the electrical control system 480 may output a signal to the hydraulic circuit 450 to move the attachment 460 to the threshold position/orientation. As a further example, the user may indicate a target speed and/or a target acceleration at which the attachment 460 is to be moved, and the electrical control system 480 may output a signal to the hydraulic circuit 450 to move the attachment 460 at or below the target speed and/or the target acceleration during movement of the attachment 460. In certain embodiments, the electrical control system 480 may block movement of the attachment 460 at the speed and/or acceleration indicated by the user input, such as in response to a determination that the user indicated speed and/or the user indicated acceleration is greater than a threshold speed and/or a threshold acceleration, to reduce stress imparted onto the system. For example, if the speed indicated by the user input is greater than the threshold speed, the electrical control system 480 may reduce movement of the attachment 460 to the threshold speed, and if the acceleration indicated by the user input is greater than the threshold acceleration, the electrical control system 480 may reduce movement of the attachment 460 to the threshold acceleration.

Figure 3:
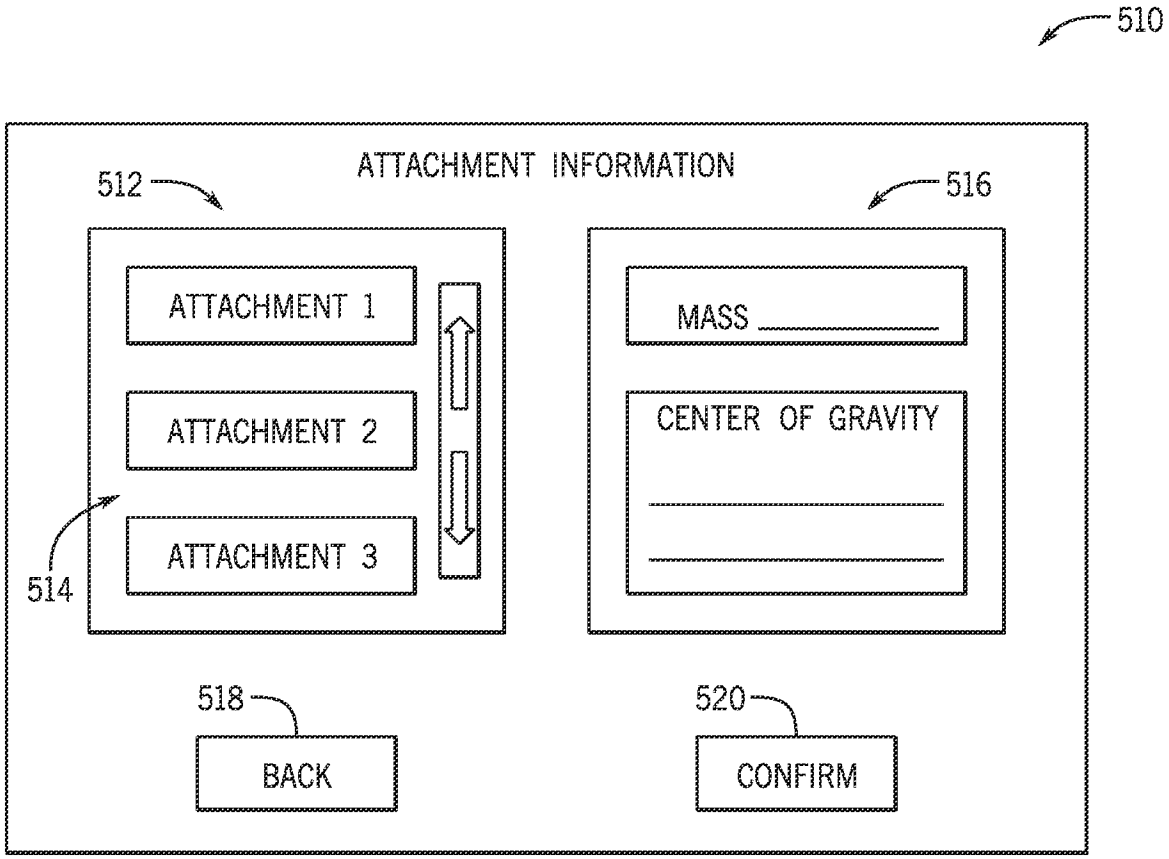
FIG. 3 is a view of an embodiment of an interface that may be presented by a user interface of an electrical control system of the hydraulic control system of FIG. 2, in accordance with an embodiment of the present disclosure.

FIG. 3 is a view of an embodiment of an interface 510 that may be presented by the user interface of the electrical control system of the hydraulic control system of FIG. 2. The interface 510 may be used to facilitate input of information regarding an attachment that is currently employed by the system (e.g., coupled to the work vehicle). Such information may subsequently be used by the electrical control system to control operation of the hydraulic circuit and movement of the attachment. For example, the interface 510 presents a first menu 512 that includes a list of candidate attachments 514 selectable by the user. The illustrated first menu 512 includes three candidate attachments, but the first menu 512 may include any suitable number of candidate attachments. Each attachment of the list of candidate attachments 514 may be associated with respective information that may be used by the electrical control system to control operation of the hydraulic circuit (e.g., a rate of fluid flow through the hydraulic circuit). By way of example, such information may include a mass (e.g., in kilograms or pounds) and/or a center of gravity (e.g., a coordinate position) of the attachment. The illustrated interface 510 also includes a second menu 516 that may present information regarding the attachment selected via the first menu 512. For instance, the second menu 516 may present the mass and/or the center of gravity of the attachment selected via the first menu 512. As such, the user may visualize the information associated with the attachment.

In some embodiments, the user may enable the user to modify the information associated with each attachment. For instance, the user may utilize the second menu 516 to modify the mass and/or the center of gravity associated with an attachment selected from the list of candidate attachments 514. The electrical control system may therefore operate the hydraulic circuit based on the modified information, rather than on pre-loaded information and/or previously submitted information. Furthermore, the user may modify the list of candidate attachments 514, such as by adding an additional attachment to the list of candidate attachments 514 and/or by removing a currently existing attachment from the list of candidate attachments 514. For example, the user may remove a currently stored attachment such that the attachment is no longer selectable via the first menu 512, and/or the user may add a new attachment, including information associated with the new attachment, to enable the new attachment to be selectable from the list of candidate attachments 514. Further still, the user may directly input the information of an attachment that is currently in use via the second menu 516. For example, the user may input the mass and/or the center of gravity without having to select an attachment from the list of candidate attachments 514 via the first menu 512, and the electrical control system may operate based on the input information.

The interface 510 additionally includes a first (e.g., "back") icon 518 and a second (e.g., "confirm") icon 520. The first icon 518 may be utilized to navigate to a different interface of the user interface without inputting and/or changing information regarding an attachment (e.g., the attachment currently employed by the system, a previously stored attachment from the list of candidate attachments 514). The second icon 520 may be used to confirm an attachment selected via the first menu 512 and/or information input via the second menu 516. For example, the interaction with the second icon 520 may cause the electrical control system to operate based on the information newly input via the interface 510.

In further embodiments, the electrical control system may be configured to determine (e.g., calculate) certain properties associated with the attachment. As an example, the sensor may detect a force and/or a torque imparted by the attachment, a pressure within the hydraulic circuit, a dimension of the system, a strain imparted on the system, other suitable parameters, or a combination thereof, to determine the mass and/or the center of gravity of the attachment. In this manner, the electrical control system may automatically determine the mass and/or the center of gravity without receiving a user input. The electrical control system may present the detected mass and/or center of gravity via the interface 510 (e.g., at the second menu 516). In some embodiments, the user may modify the detected mass and/or center of gravity using the second menu 516, and the electrical control system may operate the hydraulic circuit accordingly.

Figure 4:
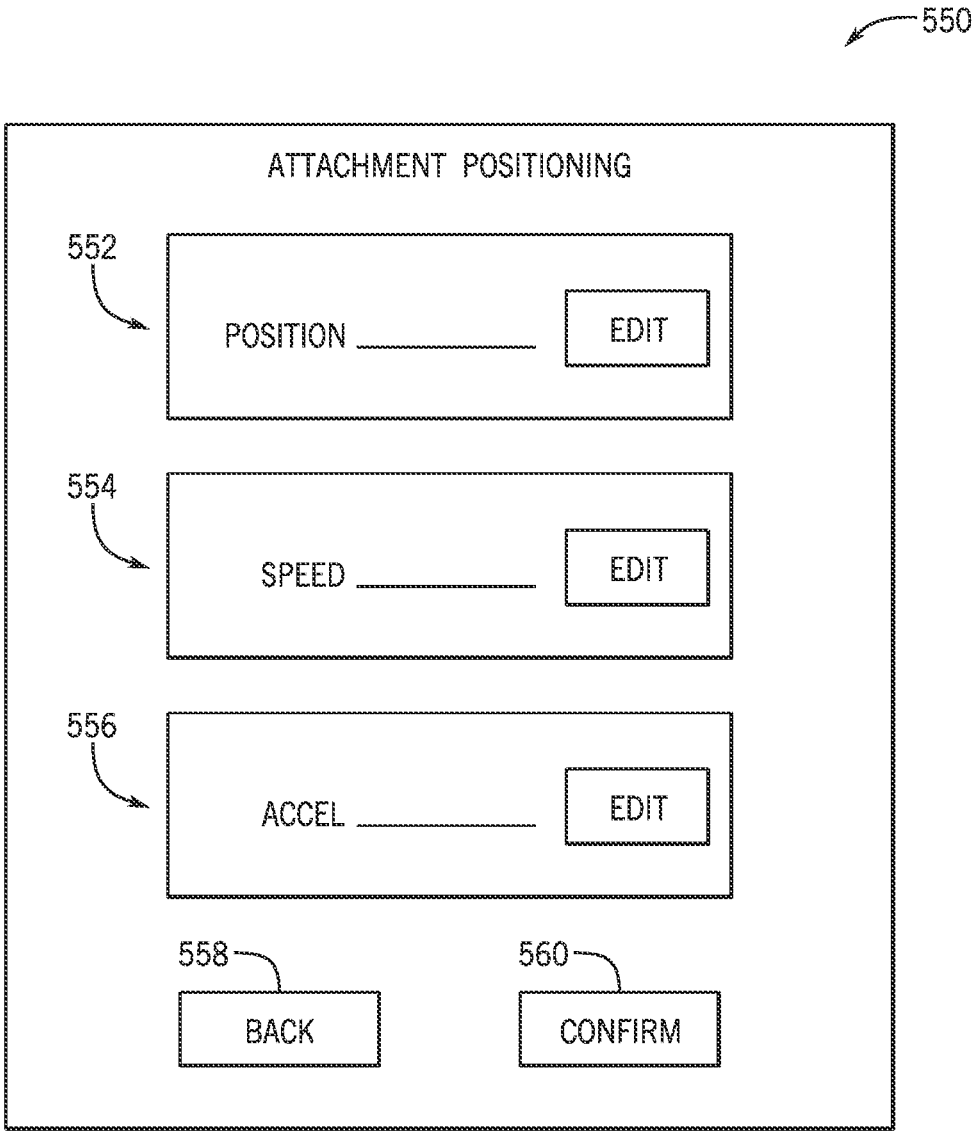
FIG. 4 is a view of an embodiment of an interface that may be presented by a user interface of an electrical control system of the hydraulic control system of FIG. 2, in accordance with an embodiment of the present disclosure.

FIG. 4 is a view of an embodiment of an interface 550 that may be presented by the user interface of the electrical control system of the hydraulic control system of FIG. 2. By way of example, the user may navigate from the interface described with respect to FIG. 3 to the illustrated interface 550 (e.g., via interaction with the first icon and/or with the second icon). The interface 550 presents various controls that enable the attachment employed by the system to be positioned and/or moved via user input. For instance, the interface 550 includes a first menu 552 that the user may utilize to input a target position of the attachment. The target position may include, for example, a location (e.g., a height) of a bucket relative to the work vehicle, a rotation of the attachment, an extension of an arm of the attachment, and so forth. The electrical control system may then operate the hydraulic circuit to adjust the attachment (e.g., via directing fluid into the hydraulic cylinder, via directing fluid out of the hydraulic cylinder) to match the position of the attachment with the target position input by the user.

The interface 550 also includes a second menu 554 that the user may utilize to input a speed at which the attachment may be moved and a third menu 556, which the user may utilize to input an acceleration in which the attachment may be moved. For example, the user may interact with the second menu 554 and the third menu 556 to input the manner in which the attachment may be moved to achieve the position indicated via the first menu 552. The electrical control system may adjust the flow rate of fluid through the hydraulic circuit based on the indicated speed and/or the indicated acceleration to move the attachment toward the target position. For instance, the electrical control system may determine a threshold speed and/or threshold acceleration based on a property of the attachment (e.g., based on a threshold flow rate of fluid associated with a property of the attachment), and the electrical control system may block the user from inputting a speed and/or acceleration greater than the threshold speed or threshold acceleration, respectively. In certain embodiments, the second menu 544 may also display the threshold speed and the threshold acceleration to indicate to the user to input a speed and/or acceleration that is less than the threshold speed or threshold acceleration, respectively.

The interface 550 further includes a third (e.g., "back") icon 558 that may be utilized to navigate to a different interface (e.g., the interface 510) without accepting the positioning/speed/acceleration of the attachment input by the user. That is, the electrical control system may not adjust the position/speed/acceleration of the attachment if the user interacts with the first icon 558. The interface 550 further includes a fourth (e.g., "confirm") icon 560 that may be utilized to confirm the input position/speed/acceleration of the attachment. As such, the electrical control system may operate the hydraulic circuit to position the attachment based on the information indicated via the interface 550 (e.g., via the first menu 552, the second menu 554, the third menu 556) in response to a selection of the fourth icon 560.

Each of FIGS. 5 and 6 discussed below presents a flowchart of a method or process for controlling an attachment. In some embodiments, each of the methods may be performed by a single component, such as the processing circuitry of the electrical control system. In additional or alternative embodiments, multiple components may perform the steps for at least one of the methods. Furthermore, additional steps may be performed with respect to the described methods.

Additionally or alternatively, certain steps of the described methods may be removed, modified, and/or performed in a different order. Further still, the steps of any of the respective methods may be performed in parallel with one another, such at the same time, and/or one method may be performed in response to initiation or completion of the other method.

FIG. 5 is a flowchart of an embodiment of a method 580 for controlling the position of the attachment of FIG. 2 based on a property (e.g., one or more properties) of the attachment. At block 582, an indication of a property of an attachment is received. The property may include a property described above, such as a mass, a center of gravity, a position, a strain, and so forth. In some embodiments, the property of the attachment may be received via a user input, such as via the user interface of the electrical control system. In additional or alternative embodiments, the property of the attachment may be automatically determined (e.g., based on sensor data).

At block 584, a threshold flow rate of fluid flowing through the hydraulic circuit may be determined based on the property of the attachment. For example, the threshold flow rate may be determined based on the mass and/or the center of gravity of the attachment. The threshold flow rate may be greater for an attachment having a smaller mass. Further, the threshold flow rate may be greater for an attachment having a center of gravity more proximate to the work vehicle. The threshold flow rate may also be determined based on a combination of the mass and the center of gravity. For instance, the threshold flow rate for a first attachment having a larger mass and a center of gravity that is more proximate to the work vehicle may be substantially the same as the threshold flow rate for a second attachment having a smaller mass and a center of gravity that is farther from the work vehicle.

At block 586, the position of the attachment is controlled based on the threshold flow rate determined at block 584. For instance, the flow rate of the fluid through the hydraulic circuit may be maintained to be at or below the threshold flow rate. To this end, the first valve, the second valve, another suitable component, or any combination thereof, may be controlled to limit the flow rate of the fluid through the hydraulic circuit. The threshold flow rate of fluid through the hydraulic circuit may establish a threshold speed and/or threshold acceleration in which the attachment may be moved. In this manner, controlling the flow rate of fluid through the hydraulic circuit at or below the threshold flow rate may limit the speed and/or acceleration of the movement of the attachment to be at or below the threshold speed and the threshold acceleration, respectively, thereby reducing a stress imparted onto the system. As an example, an input indicative of a target flow rate of the attachment may be received (e.g., via a user input). In response to the target flow rate being greater than the threshold flow rate, the hydraulic circuit may be controlled to direct the fluid at the threshold flow rate instead of at the target flow rate to limit the stress imparted onto the system.

In some embodiments, a notification may be output based on the determination of how the attachment is controlled. For instance, a visualization may be displayed to indicate that the attachment is being operated in accordance with the target flow rate based on a determination that the target flow rate is less than the threshold flow rate. Additionally or alternatively, a visualization may be displayed to indicate that the attachment is being operated in accordance with the threshold flow rate based on a determination that the target flow rate is greater than the threshold flow rate. In this manner, the user may be notified regarding how the attachment is being positioned.

In certain embodiments, the threshold flow rate of fluid through the hydraulic circuit may be dynamically determined and adjusted during operation of the attachment, such as during a transitioning of the attachment between different configurations. As an example, the change in configuration of the attachment may include a change in the position of the attachment. For example, a first threshold flow rate may be determined based on the attachment being at a first position (e.g., an initial position). When the attachment moves to a second position (e.g., to transition toward a final position), a second threshold flow rate may be determined based on the attachment being at the second position. Indeed, changing the positioning of the attachment may also vary the center of gravity of the attachment (e.g., relative to the work vehicle) or otherwise change how stress is imparted onto the system. As such, an updated threshold flow rate may, therefore, be determined based on the adjusted position and/or the adjusted center of gravity of the attachment to reduce such stress imparted onto the system, even though the mass of the attachment may be substantially the same. In this manner, multiple threshold flow rates may be determined as the attachment is moved (e.g., based on a position of the attachment as detected by a sensor), and operation of the hydraulic circuit may correspondingly be adjusted based on the different threshold flow rates. As another example, the change in configuration of the attachment may include a change in mass associated with the attachment. For instance, an amount of material collected by the attachment (e.g., in the bucket of the attachment) may change during operation of the attachment. Accordingly, the threshold flow rate may be updated based on the change in mass (e.g., as detected by the sensor).

FIG. 6 is a flowchart of an embodiment of a method 600 for controlling the position of the attachment of FIG. 2 based on a property of the attachment. At block 582, an indication of a property of an attachment is received, such as in a similar manner as described with respect to FIG. 5. At block 602, a threshold speed and/or threshold acceleration of the attachment (e.g., of the attachment relative to the work vehicle, of portions of the attachment relative to one another) may be determined based on the property of the attachment. In some embodiments, the threshold speed and/or threshold acceleration may be determined based on a combination of a mass and center of gravity of the attachment. As an example, the threshold speed and/or threshold acceleration may be greater for an attachment having a smaller mass and/or having a center of gravity more proximate to the work vehicle.

At block 604, the position of the attachment is controlled based on the threshold speed and/or threshold acceleration determined at block 602. For instance, the speed and/or acceleration of the movement of the attachment may be maintained to be at or below the threshold speed and threshold acceleration, respectively, such as by controlling the first valve and/or the second valve. In some embodiments, the speed and/or acceleration of the attachment may be controlled by directing the fluid at or below a threshold flow rate of fluid through the hydraulic circuit. In additional or alternative embodiments, the speed and/or acceleration of the attachment may be controlled based on current movement of the attachment (e.g., a current speed and/or current acceleration sensed by a sensor). In an example, an input indicative of a target speed and/or target acceleration may be received (e.g., via a user input). The target speed and/or target acceleration may then be compared with the threshold speed and/or threshold acceleration, respectively. If the target speed and/or target acceleration is less than the threshold speed and/or threshold acceleration, respectively, the attachment may be controlled based on the target speed and/or target acceleration. However, if the target speed and/or target acceleration is greater than the threshold speed and/or threshold acceleration, respectively, the attachment may be controlled based on the threshold speed and/or threshold acceleration instead of based on the target speed and/or target acceleration to limit the stress imparted on the system. In some embodiments, a notification may be output to indicate how the attachment is being controlled (e.g., whether the attachment is being controlled based on the threshold speed and/or threshold acceleration, whether the attachment is being controlled based on the target speed and/or target acceleration).

In certain embodiments, the threshold speed and/or threshold acceleration of the attachment may be dynamically determined and adjusted during operation of the attachment, such as during a transitioning of the attachment between different configurations. That is, the center of gravity and/or mass of the attachment may change during operation of the attachment, and the threshold speed and/or threshold acceleration may be updated based on the change in center of gravity and/or mass to limit stress imparted onto the system. Thus, multiple threshold speeds and/or threshold accelerations may be determined as the attachment is moved, and operation of the hydraulic circuit may correspondingly be adjusted based on the different threshold speeds and/or threshold accelerations.

While only certain features of the disclosure have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A system, comprising:

a hydraulic circuit configured to control a position of at least a portion of an attachment of the system; and a control system configured to perform operations comprising:

receiving an input indicative of a center of gravity of the attachment; and controlling a flow rate of fluid directed through the hydraulic circuit based on the center of gravity, wherein the control system comprises a user interface, and the control system is configured to receive the input indicative of the center of gravity via a user input into the user interface.

2. The system of claim 1, wherein the control system is configured to store information associated with a plurality of candidate attachments, the plurality of candidate attachments comprises the attachment, the information comprises a respective center of gravity associated with each attachment of the plurality of candidate attachments, and the user input comprises a selection of the attachment of the plurality of candidate attachments.

3. The system of claim 2, wherein the control system is configured to perform operations comprising:

receiving an additional user input comprising a modification to the center of gravity associated with an additional attachment of the plurality of candidate attachments; and updating the information associated with the additional attachment of the plurality of candidate attachments based on the additional user input.

4. The system of claim 1, wherein the control system is configured to determine a threshold flow rate of the fluid based on the center of gravity and to control the flow rate of the fluid directed through the hydraulic circuit to be at or below the threshold flow rate.

5. The system of claim 1, wherein the hydraulic circuit comprises a hydraulic cylinder coupled to the attachment, and the control system is configured to control the flow rate of the fluid into the hydraulic cylinder, out of the hydraulic cylinder, or both, based on the center of gravity to control movement of at least the portion of the attachment.

6. The system of claim 1, wherein the control system is configured to perform operations comprising:

receiving an additional input indicative of a current position of the attachment; and controlling the flow rate of the fluid directed through the hydraulic circuit based on the current position and the center of gravity.

7. The system of claim 1, comprising a sensor communicatively coupled to the control system, wherein the sensor is configured to output sensor data indicative of a property comprising a mass of the attachment, a position of the attachment, a pressure within the hydraulic circuit, a strain on the system, or any combination thereof, and the control system is configured to determine the center of gravity of the attachment based on the property.

8. A tangible, non-transitory, computer readable medium comprising instructions that, when executed by processing circuitry, are configured to cause the processing circuitry to perform operations comprising:

receiving an input indicative of a center of gravity of an attachment coupled to a work vehicle of a system;

determining a threshold flow rate of fluid through a hydraulic circuit of the system based on the center of gravity of the attachment;

controlling the hydraulic circuit of the system to direct the fluid through the hydraulic circuit at a flow rate below the threshold flow rate to control movement of at least a portion of the attachment;

receiving an additional input indicative of a target flow rate of the fluid through the hydraulic circuit;

determining whether the target flow rate is below the threshold flow rate; and controlling the hydraulic circuit to direct the fluid through the hydraulic circuit at the target flow rate in response to a determination that the target flow rate is below the threshold flow rate.

9. The tangible, non-transitory, computer readable medium of claim 8, wherein the instructions, when executed by processing circuitry, are configured to cause the processing circuitry to perform operations comprising:

receiving the input indicative of the center of gravity of the attachment at a first configuration of the attachment;

determining the threshold flow rate of the fluid based on the center of gravity of the attachment;

controlling the hydraulic circuit of the system based on the threshold flow rate to transition the attachment to a second configuration;

receiving an additional input indicative of an additional center of gravity of the attachment at the second configuration of the attachment;

determining an additional threshold flow rate of the fluid through the hydraulic circuit based on the additional center of gravity of the attachment; and controlling the hydraulic circuit of the system based on the additional threshold flow rate to control movement of at least the portion of the attachment.

10. The tangible, non-transitory, computer readable medium of claim 8, wherein the instructions, when executed by processing circuitry, are configured to cause the processing circuitry to control the hydraulic circuit to direct the fluid through the hydraulic circuit at an additional flow rate in response to a determination that the target flow rate is above the threshold flow rate, the additional flow rate being less than or equal to the threshold flow rate.

11. The tangible, non-transitory, computer readable medium of claim 10, wherein the instructions, when executed by processing circuitry, are configured to cause the processing circuitry to receive the input, the additional input, or both, via a user interface.

12. The tangible, non-transitory, computer readable medium of claim 8, wherein the instructions, when executed by processing circuitry, are configured to cause the processing circuitry to output a signal to a valve of the hydraulic circuit to direct the fluid through the hydraulic circuit at the flow rate below the threshold flow rate.

13. An system, comprising:

a hydraulic circuit configured to control a position of at least a portion of an attachment of the system; and a control system configured to perform operations comprising:

receiving an input indicative of a center of gravity of the attachment;

determining a threshold speed, a threshold acceleration, or both, of at least the portion of the attachment;

controlling the hydraulic circuit to direct fluid through the hydraulic circuit to move at least the portion of the attachment at or below the threshold speed, the threshold acceleration, or both;

receiving an additional input indicative of a target speed, a target acceleration, or both;

comparing the target speed to the threshold speed, comparing the target acceleration to the target acceleration, or both; and controlling the hydraulic circuit to direct the fluid through the hydraulic circuit to move at least the portion of the attachment at the target speed in response to a determination that the target speed is below the threshold speed, controlling the hydraulic circuit to direct fluid through the hydraulic circuit to move at least the portion of the attachment at the target acceleration in response to a determination that the target acceleration is below the threshold acceleration, or both, wherein the control system is configured to control the hydraulic circuit to direct the fluid through the hydraulic circuit to move at least the portion of the attachment at an additional speed that is lower than the threshold speed in response to a determination that the target speed is above the threshold speed, to control the hydraulic circuit to direct the fluid through the hydraulic circuit to move at least the portion of the attachment at an additional acceleration that is lower than the threshold acceleration in response to a determination that the target acceleration is above the threshold acceleration, or both.

14. The system of claim 13, wherein the control system is configured to perform operations comprising:

dynamically determining the threshold speed, the threshold acceleration, or both, based on a current position of the attachment; and controlling the hydraulic circuit to direct the fluid through the hydraulic circuit to adjust the current position of the attachment at or below the threshold speed, the threshold acceleration, or both, dynamically determined based on the current position.

15. The system of claim 13, wherein the control system is configured to perform operations comprising:

receiving an additional input indicative of a mass of the attachment; and determining the threshold speed, the threshold acceleration, or both, of at least the portion of the attachment based on the mass and the center of gravity.

* * * * *